US007330165B2

(12) United States Patent
Tachibana et al.

(10) Patent No.: US 7,330,165 B2
(45) Date of Patent: Feb. 12, 2008

(54) METHOD OF DRIVING PLASMA DISPLAY PANEL

(75) Inventors: Hiroyuki Tachibana, Osaka (JP); Naoki Kosugi, Kyoto (JP); Nobuaki Nagao, Osaka (JP); Ryuichi Murai, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 229 days.

(21) Appl. No.: 10/515,599

(22) PCT Filed: Mar. 23, 2004

(86) PCT No.: PCT/JP2004/003950

§ 371 (c)(1),
(2), (4) Date: Nov. 24, 2004

(87) PCT Pub. No.: WO2004/086341

PCT Pub. Date: Oct. 7, 2004

(65) Prior Publication Data

US 2006/0050023 A1 Mar. 9, 2006

(30) Foreign Application Priority Data

Mar. 24, 2003 (JP) ..... 2003-080301

(51) Int. Cl.
*G09G 3/28* (2006.01)

(52) U.S. Cl. ..... 345/63; 345/60; 345/67; 345/68

(58) Field of Classification Search ..... 345/60–69, 345/204–215; 315/169.1–169.4
See application file for complete search history.

(56) References Cited

U.S. PATENT DOCUMENTS

| | | | | |
|---|---|---|---|---|
| 6,469,685 | B1 * | 10/2002 | Woodruff et al. | 345/60 |
| 6,496,167 | B2 * | 12/2002 | Makino | 345/60 |
| 6,833,824 | B2 * | 12/2004 | Ide et al. | 345/66 |
| 2001/0026254 | A1 * | 10/2001 | Ide et al. | 345/60 |
| 2004/0056606 | A1 * | 3/2004 | Ide et al. | 315/169.3 |
| 2004/0095294 | A1 * | 5/2004 | Yamada | 345/60 |
| 2004/0239593 | A1 * | 12/2004 | Yamada | 345/63 |

FOREIGN PATENT DOCUMENTS

| | | |
|---|---|---|
| JP | 8-96714 | 4/1996 |
| JP | 9-245627 | 9/1997 |
| JP | 11-144626 | 5/1999 |
| JP | 11-297211 | 10/1999 |
| JP | 2001-185034 | 7/2001 |

* cited by examiner

*Primary Examiner*—Vijay Shankar
(74) *Attorney, Agent, or Firm*—Wenderoth, Lind & Ponack, L.L.P.

(57) ABSTRACT

A method drives a plasma display panel including priming electrodes. In the writing period of a sub-field, prior to the scanning of respective scan electrodes, priming discharge is caused between the scan electrodes and the priming electrodes. The time interval between the application of voltage to the priming electrodes for causing the priming discharge and the scanning of the corresponding scan electrodes is set within 10 μs.

19 Claims, 10 Drawing Sheets

METHOD OF DRIVING PLASMA DISPLAY PANEL

TECHNICAL FIELD

The present invention relates to a method of driving an alternating-current (AC) type plasma display panel.

BACKGROUND ART

A plasma display panel (hereinafter abbreviated as a PDP or a panel) is a display device having excellent visibility and featuring a large screen, thinness and light weight. The systems of discharging a PDP include an alternating current (AC) type and direct-current (DC) type. The electrode structures thereof include a three-electrode surface-discharge type and an opposite-discharge type. However, the current mainstream is an AC type three-electrode PDP, which is an AC surface-discharge type, because this type of PDP is suitable for higher definition and easy to manufacture.

Generally, an AC type three-electrode PDP has a large number of discharge cells formed between a front panel and a rear panel facing each other. In the front panel, a plurality of display electrodes, each made of a pair of a scan electrode and a sustain electrode, are formed on a front glass substrate in parallel with each other. A dielectric layer and a protective layer are formed to cover these display electrodes. In the rear panel, a plurality of parallel data electrodes is formed on a rear glass substrate. A dielectric layer is formed on the data electrodes to cover them. Further, a plurality of barrier ribs is formed on the dielectric layer in parallel with the data electrodes. Phosphor layers are formed on the surface of the dielectric layer and the side faces of the barrier ribs. Then, the front panel and the rear panel are facing each other and sealed together so that the display electrodes and data electrodes intersect with each other. A discharge gas is filled into an inside discharge space formed therebetween. In a panel structured as above, ultraviolet light is generated by gas discharge in each discharge cell. This ultraviolet light excites respective phosphors to emit R, G, or B color, for color display.

A general method of driving a panel is a so-called sub-field method in which one field period is divided into a plurality of sub-fields and a combination of light-emitting sub-fields provides gradation images for display. Each of the sub-fields has an initializing period, writing period, and sustaining period.

In the initializing period, all the discharge cells perform an initializing discharge operation at a time to erase the history of wall electric charge previously formed in respective discharge cells and form wall electric charge necessary for the subsequent writing operation. Additionally, this initializing discharge operation serves to generate priming (priming for discharge=excited particles) for causing stable writing discharge.

In the writing period, scan pulses are sequentially applied to scan electrodes, and write pulses corresponding to the signals of an image to be displayed are applied to data electrodes. Thus, selective writing discharge is caused between scan electrodes and corresponding data electrodes for selective formation of wall electric charge.

In the subsequent sustaining period, a predetermined number of sustain pulses are applied between scan electrodes and corresponding sustain electrodes. Then, the discharge cells in which the wall electric charge are formed by the writing discharge are selectively discharged and light is emitted from the discharge cells.

In this manner, to properly display an image, selective writing discharge must securely be performed in the writing period. However, there are many factors in increasing discharge delay in the writing discharge, such as: restraints of the circuitry inhibit the use of high voltage for write pulses; and phosphor layers formed on the data electrodes make discharge difficult. For these reasons, priming for generating stable writing discharge is extremely important.

However, the priming caused by discharge rapidly decreases as time elapses. This causes the following problems in the method of driving a panel described above. In writing discharge occurring a long time after the initializing discharge, priming generated in the initializing discharge is insufficient. This insufficient priming causes a large discharge delay and an unstable writing operation, thus degrading the image display quality. Additionally, when a long writing period is set for a stable writing operation, the time taken for the writing period is too long.

Proposed to address these problems are a panel and method of driving the panel in which auxiliary discharge electrodes are provided and discharge delay is minimized using priming caused by an auxiliary discharge (see Japanese Patent Unexamined Publication No. 2002-297091, for example).

However, such panels have the following problems. Because the discharge delay of the auxiliary discharge itself is large, the discharge delay of the writing discharge cannot sufficiently be shortened. Additionally, because the operating margin of the auxiliary discharge is small, incorrect discharge may be induced in some panels.

Further, when the number of scan electrodes is increased for higher definition without shortening the discharge delay in the writing discharge sufficiently, the time taken for the writing period is too long and the time taken for the sustaining period is insufficient. As a result, luminance decreases. Additionally, increasing the partial pressure of xenon to increase the luminance and efficiency further increases the discharge delay and makes the writing operation unstable.

The present invention addresses these problems and aims to provide a method of driving a plasma display panel capable of performing stable and high-speed writing operation.

SUMMARY OF THE INVENTION

To address these problems, the method of driving a plasma display panel of the present invention is a method of driving a plasma display panel having priming electrodes, in which priming discharge is generated prior to scanning of respective scan electrodes, in a wiring period of a sub-field.

DETAILED DESCRIPTION OF PREFERRED EMBODIMENTS

Methods of driving plasma display panels in accordance with exemplary embodiments of the present invention are described hereinafter with reference to the accompanying drawings.

First Exemplary Embodiment

Figure 1:
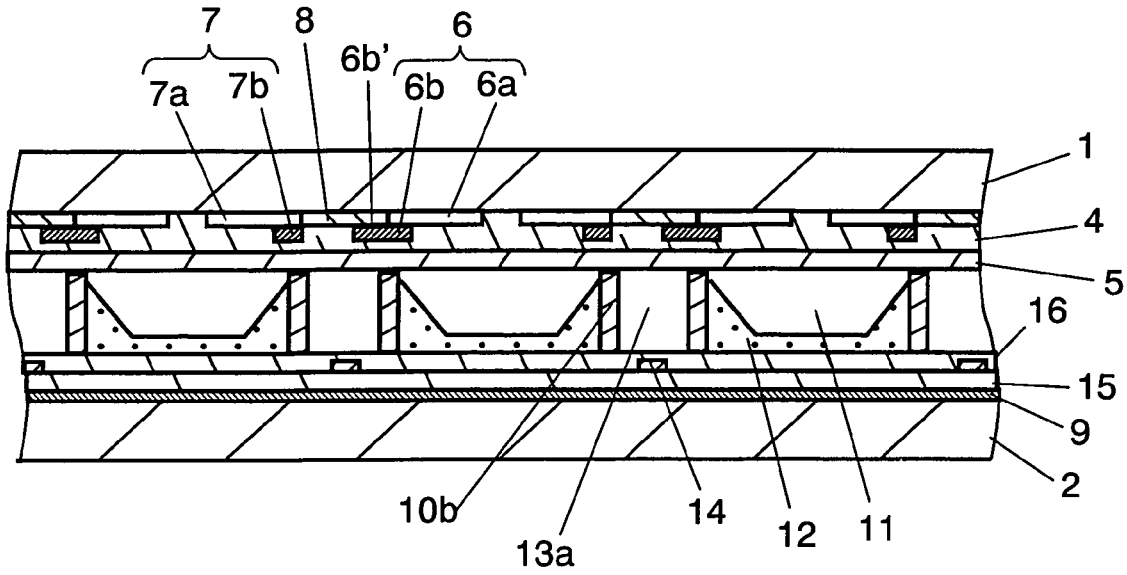
FIG. 1 is a sectional view showing an example of a panel used for a first exemplary embodiment of the present invention.
Figure 2:
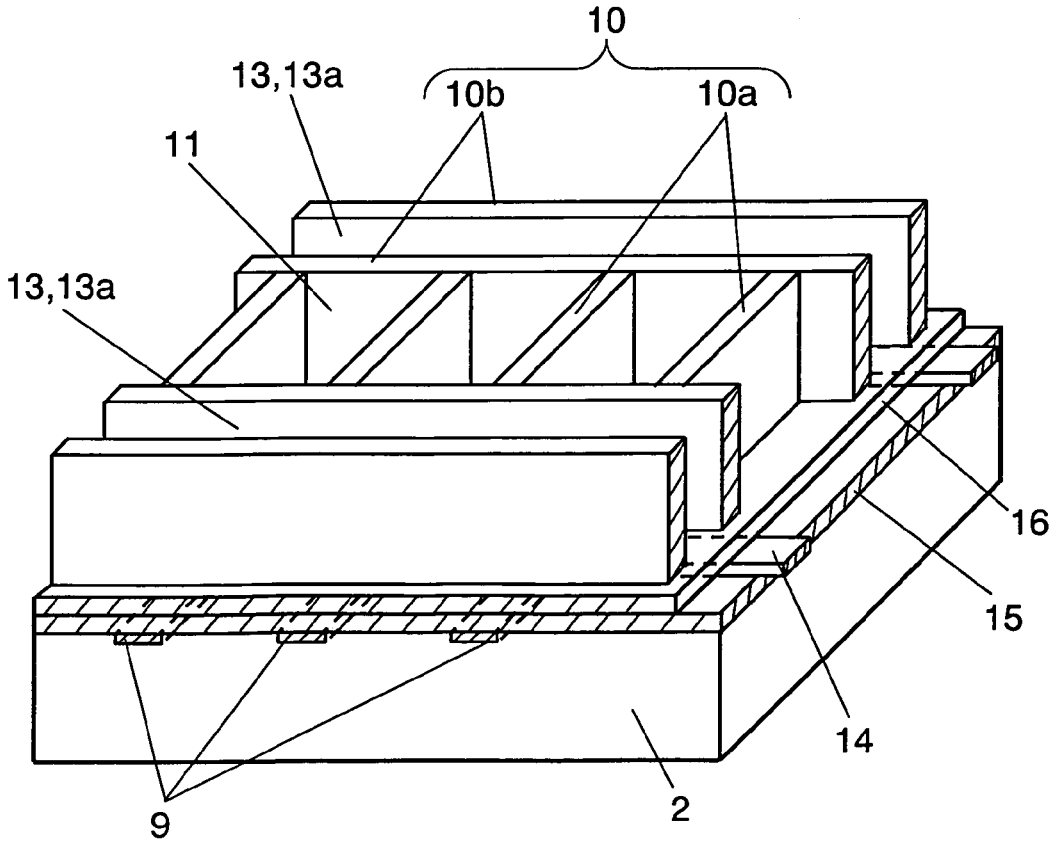
FIG. 2 is a schematic perspective view showing a structure of a rear substrate side of the panel.

FIG. 1 is a sectional view showing an example of a panel used for the first exemplary embodiment of the present invention. FIG. 2 is a schematic perspective view showing the structure of the rear substrate side of the panel.

As shown in FIG. 1, front substrate 1 and rear substrate 2 both made of glass face each other to sandwich a discharge space therebetween. In the discharge space, a mixed gas of neon and xenon for radiating ultraviolet light by discharge is filled.

On front substrate 1, a plurality of pairs of a scan electrode 6 and sustain electrode 7 are formed in parallel with each other. Scan electrode 6 and sustain electrode 7 are made of transparent electrodes 6*a* and 7*a*, and metal buses 6*b* and 7*b* formed on transparent electrodes 6*a* and 7*a*, respectively. Now, between each scan electrode 6 and corresponding sustain electrode 7 on the side where metal buses 6*b* and 7*b* are formed, a light-absorbing layer 8 made of a black material is provided. Projection 6*b*' of metal bus 6*b* in scan electrode 6 projects onto light-absorbing layer 8. Dielectric layer 4 and protective layer 5 are formed to cover the scan electrodes 6, sustain electrodes 7, and light-absorbing layers 8.

On rear substrate 2, a plurality of data electrodes 9 is formed in parallel with each other. Dielectric layer 15 is formed to cover these data electrodes 9. Further on the dielectric layer, barrier ribs 10 for partitioning the discharge space into discharge cells 11 are formed. As shown in FIG. 2, each barrier rib 10 is made of vertical walls 10*a* extending in parallel with data electrodes 9, and horizontal walls 10*b* for forming discharge cells 11 and forming a clearance 13 between discharge cells 11. In each clearance 13, priming electrode 14 is formed in the direction orthogonal to data electrodes 9, to form priming space 13*a*. On the surface of dielectric layer 15 corresponding to discharge cells 11 partitioned by barrier ribs 10 and the side faces of barrier ribs 10, phosphor layers 12 are provided. However, no phosphor layer 12 is provided on the side of clearances 13.

When front substrate 1 is faced and sealed with rear substrate 2, each projection 6*b*' of metal bus 6*b* in scan electrode 6 formed on front substrate 1 that projects onto light-absorbing layer 8 is positioned in parallel with corresponding priming electrode 14 on rear substrate 2 and faced therewith to sandwich priming space 13*a*. In other words, the panel shown in FIGS. 1 and 2 is structured to perform priming discharge between projections 6*b*' formed on the side of front substrate 1 and priming electrodes 14 formed on the side of rear substrate 2.

In FIGS. 1 and 2, dielectric layer 16 is further formed to cover priming electrodes 14; however, this dielectric layer 16 need not be formed necessarily.

Figure 3:
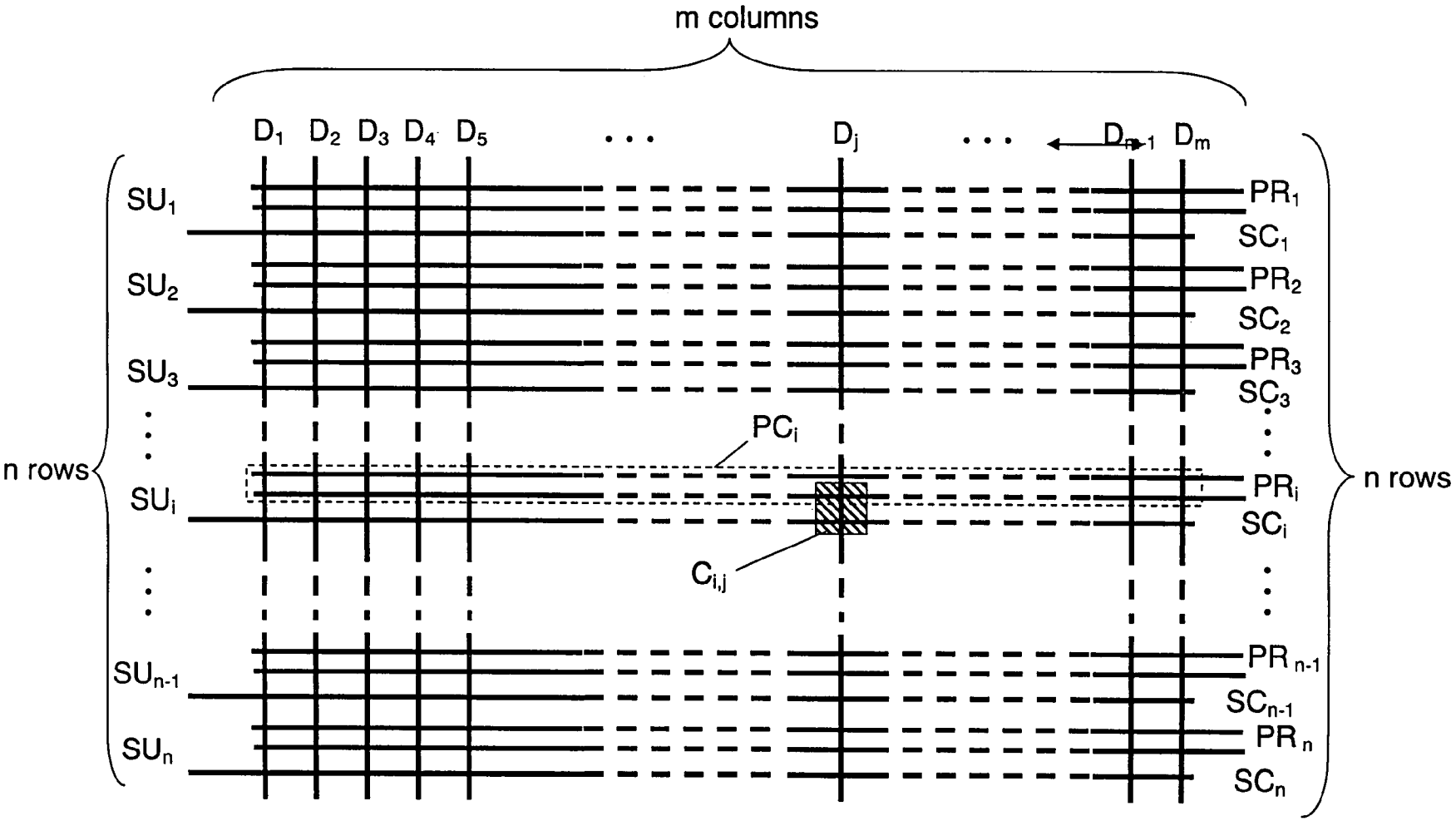
FIG. 3 is a diagram showing an arrangement of electrodes in the panel.

FIG. 3 is a diagram showing an arrangement of electrodes in the panel used for the first exemplary embodiment of the present invention. M columns of data electrodes $D_1$ to $D_m$ (data electrodes 9 in FIG. 1) are arranged in the column direction. N rows of scan electrodes $SC_1$ to $SC_n$ (scan electrodes 6 in FIG. 1), and n rows of sustain electrodes $SU_1$ to $SU_n$ (sustain electrodes 7 in FIG. 1) are alternately arranged in the row direction. Further, n rows of priming electrodes $PR_1$ to $PR_n$ are arranged to be faced with the projections in scan electrodes $SC_1$ to $SC_n$. Thus, m×n discharge cells $C_{ij}$ (discharge cells 11 in FIG. 1), each including a pair of a scan electrode $SC_i$ and a sustain electrode $SU_i$ (i=1 to n) and one data electrode $D_j$ (j=1 to m), are formed in the discharge space. In clearances 13, n rows of priming spaces $PS_i$ (priming space 13*a* in FIG. 1), each including the projection of scan electrode $SC_i$ and priming electrode $PR_i$, are formed.

Next, a driving waveform for driving the panel and timing of the driving waveform are described.

Figure 4:
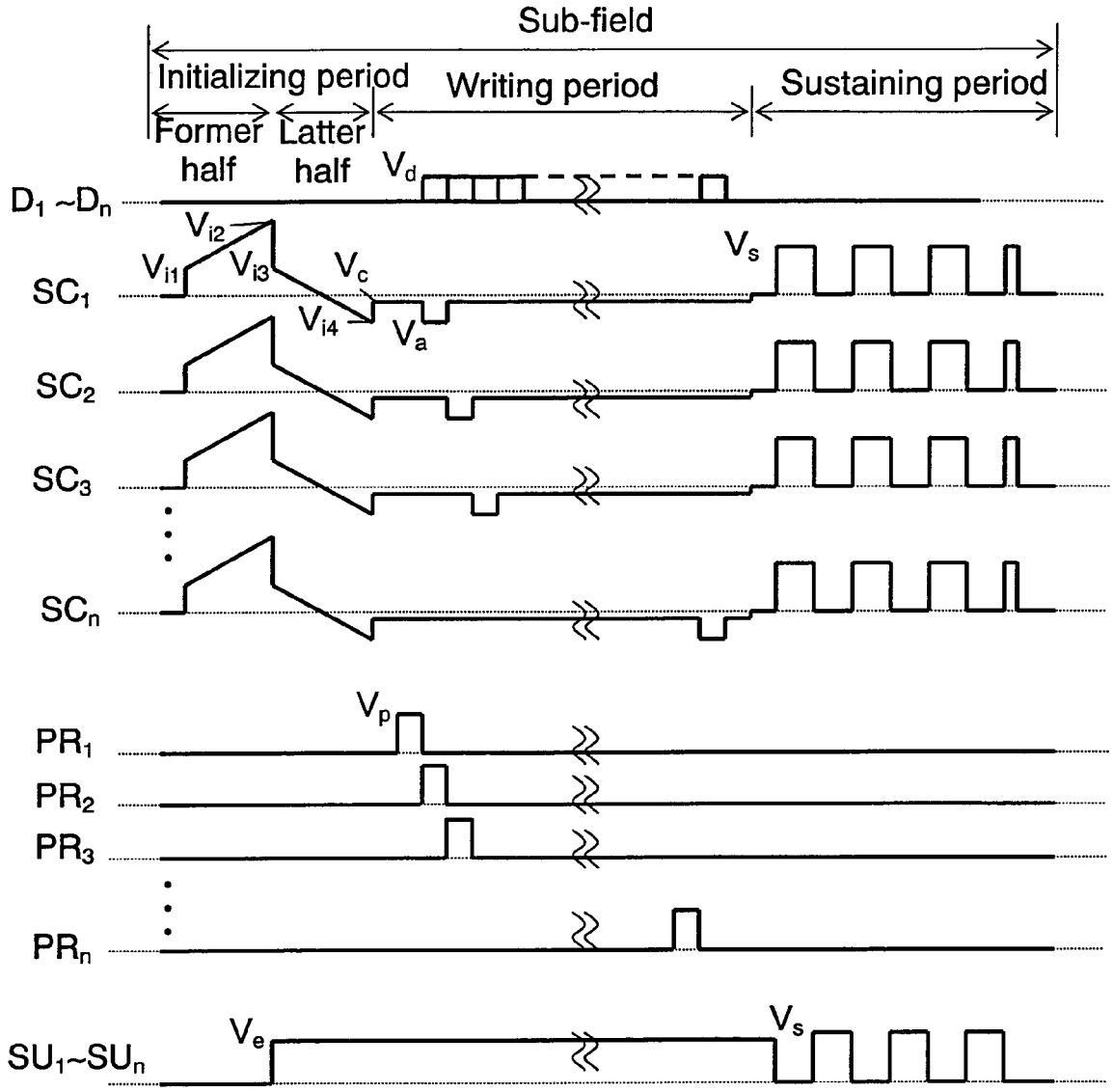
FIG. 4 is a diagram showing a driving waveform in a method of driving the panel.

FIG. 4 is a diagram showing a driving waveform in the method of driving the panel used for the first exemplary embodiment of the present invention. In this embodiment, one field period is made of a plurality of sub-fields, each including an initializing period, writing period, and sustaining period. Because the same operation is performed in each sub-field, except for the number of sustain pulses in the sustaining period, operation in one sub-filed is described hereinafter.

In the former half of the initializing period, each of data electrodes $D_1$ to $D_m$, sustain electrodes $SU_1$ to $SU_n$, and priming electrodes $PR_1$ to $PR_n$ is held at 0 (V). Applied to each of scan electrodes $SC_1$ to $SC_n$ is a ramp waveform voltage gradually increasing from a voltage of $V_{i1}$ not larger than a discharge-starting voltage across the scan electrodes $SC_1$ to $SC_n$ and sustain electrodes $SU_1$ to $SU_n$ to a voltage of $V_{i2}$ exceeding the discharge-starting voltage. While the ramp waveform voltage increases, first weak initializing discharge occurs between scan electrodes $SC_1$ to $SC_n$, and sustain electrodes $SU_1$ to $SU_n$, data electrodes $D_1$ to $D_m$, and priming electrodes $PR_1$ to $PR_n$. Thus, negative wall voltage accumulates on scan electrodes $SC_1$ to $SC_n$, and positive wall voltage accumulates on data electrodes $D_1$ to $D_m$, sustain electrodes $SU_1$ to $SU_n$, and priming electrodes $PR_1$ to $PR_n$. Now, the wall voltage on the electrodes is the voltage generated by the wall charge accumulating on the dielectric layers covering the electrodes.

In the latter half of the initializing period, each of sustain electrode $SU_1$ to $SU_n$ is held at a positive voltage of Ve. Applied to each of scan electrodes $SC_1$ to $SC_n$ is a ramp waveform voltage gradually decreasing from a voltage of $V_{i3}$ not larger than the discharge-starting voltage across the scan electrodes $SC_1$ to $SC_n$ and sustain electrodes $SU_1$ to $SU_n$ to a voltage of $V_{i4}$ exceeding the discharge-starting voltage. During this application of the ramp voltage, second weak initializing discharge occurs between scan electrodes $SC_1$ to $SC_n$, and sustain electrodes $SU_1$ to $SU_n$, data electrodes $D_1$ to $D_m$, and priming electrodes $PR_1$ to $PR_n$. Then, the negative wall voltage on scan electrodes $SC_1$ to $SC_n$ and the positive wall voltage on sustain electrodes $SU_1$ to $SU_n$ are weakened. The positive wall voltage on data electrodes $D_1$ to $D_m$ is adjusted to a value appropriate for a writing operation. The positive wall voltage on priming electrodes $PR_1$ to $PR_n$ is also adjusted to a value appropriate for a priming operation. Thus, the initializing operation is completed.

In the writing period, scan electrodes $SC_1$ to $SC_n$ are once held at a voltage of Vc. Then, a voltage of Vp is applied to priming electrode $PR_1$ of the first row. Especially in this case, voltage Vp is a high voltage sufficiently exceeding a voltage change ($Vc-Vi_4$) in scan electrodes $SC_1$ to $SC_n$. This causes priming discharge between priming electrode $PR_1$ and the projection of scan electrode $SC_1$, and the priming diffuses inside of discharge cells $C_{1,1}$ to $C_{1,m}$ in the first row corresponding to scan electrode $SC_1$ of the first row.

Next, scan pulse voltage Va is applied to scan electrode $SC_1$ of the first row, and positive write pulse voltage Vd is applied to data electrode $D_k$ (k being an integer ranging from 1 to m) corresponding to the signal of an image to be displayed in the first row among data electrodes $D_1$ to $D_k$. At this time, discharge occurs at the intersection of data electrode Dk to which write pulse voltage Vd has been applied and scan electrode $SC_1$. This discharge develops to discharge between sustain electrode $SU_1$ and scan electrode $SC_1$ in corresponding discharge cell $C_{1,k}$. Then, positive wall voltage accumulates on scan electrode $SC_1$, and negative wall voltage accumulates on sustain electrode $SU_1$ in discharge cell $C_{1,k}$. Now, discharge occurs in discharge cell $C_{1,k}$ in the first row including scan electrode $SC_1$ of the first row with sufficient priming supplied from the priming discharge that has occurred between scan electrode $SC_1$ and priming electrode $PR_1$ immediately before the discharge. For this reason, discharge delay is extremely small, and thus high-speed and stable discharge occurs.

At the time of the above-mentioned writing operation in scan electrode $SC_1$ of the first row, voltage Vp is applied to priming electrode $PR_2$ corresponding to scan electrode $SC_2$ of the second row to cause priming discharge and diffuse the priming inside of discharge cells $C_{2,1}$ to $C_{2,m}$ in the second row corresponding to scan electrode $SC_2$ of the second row.

In a similar manner, writing discharge in the second row and priming discharge in the third row are performed. At this time, a series of writing discharge operations are performed with sufficient priming supplied from the priming discharge that has occurred immediately before the writing discharge operations. For this reason, the discharge delay is small and thus high-speed and stable discharge occurs.

Similar writing operations are performed in discharge cells including $C_{n,k}$, and the writing operation is completed.

In the sustaining period, after scan electrodes $SC_1$ to $SC_n$ and sustain electrodes $SU_1$ to $SU_n$ are reset to 0 (V) once, a positive sustain pulse voltage of Vs is applied to scan electrodes $SC_1$ to $SC_n$. At this time, in the voltage on scan electrode $SC_i$ and sustain electrode $SU_i$ in discharge cell $C_{i,j}$ in which writing discharge has occurred, the wall voltage accumulating on scan electrode $SC_i$ and sustain electrode $SU_i$ is added to sustain pulse voltage Vs. For this reason, the voltage exceeds the discharge-starting voltage and sustain discharge occurs. In a similar manner, by alternately applying sustain pulses to scan electrodes $SC_1$ to $SC_n$ and sustain electrodes $SU_1$ to $SU_n$, sustain discharge operations are successively performed in discharge cell $C_{i,j}$ in which the writing discharge has occurred, the number of times of sustain pulses.

As described above, unlike the writing discharge depending only on the priming in the initializing discharge in accordance with a conventional driving method, the writing discharge of the driving method in accordance with the present invention is performed with sufficient priming supplied from the priming discharge that has occurred immediately before the writing operation in respective discharge cells. This can achieve high-speed and stable writing discharge with a small discharge delay, and display a high-quality image.

Figure 5:
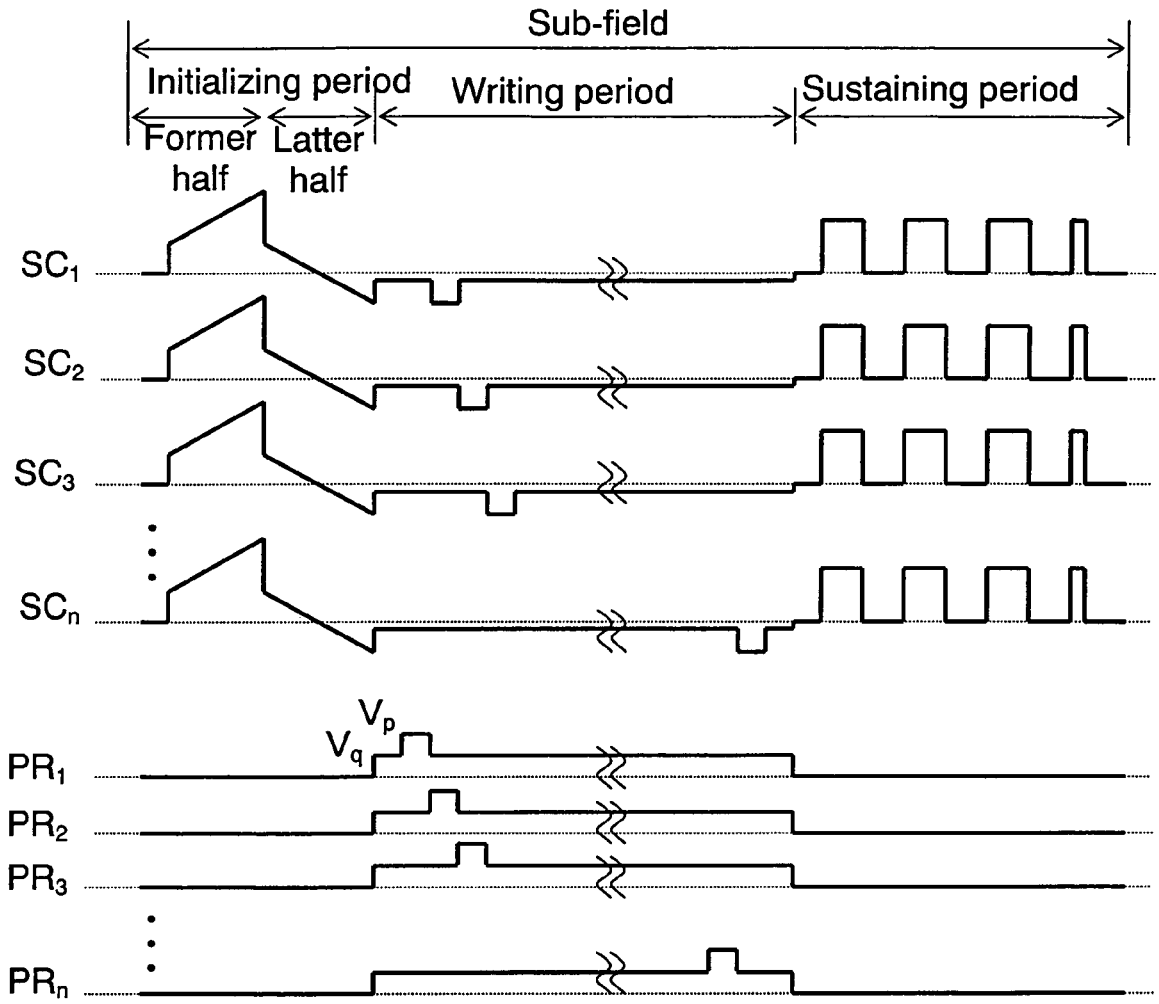
FIG. 5 is a diagram showing another driving waveform in a method of driving the panel.

FIG. 5 is a diagram showing another driving waveform in a method of driving the panel used for the first exemplary embodiment of the present invention. As shown in FIG. 5, in the writing period, a voltage Vq not larger than the discharge-starting voltage (e.g., $Vq=Vc-Vi_4$) can commonly be applied to all of the priming electrodes and the potential difference from voltage Vp, i.e., voltage Vp−Vq, can further be applied to the priming electrodes to be discharged, as a waveform applied to the priming electrodes. This case has an advantage of achieving a driver circuit using a driver IC with a low withstand voltage, because voltage Vp−Vq separately applied to each priming electrode for driving is low.

Figure 6:
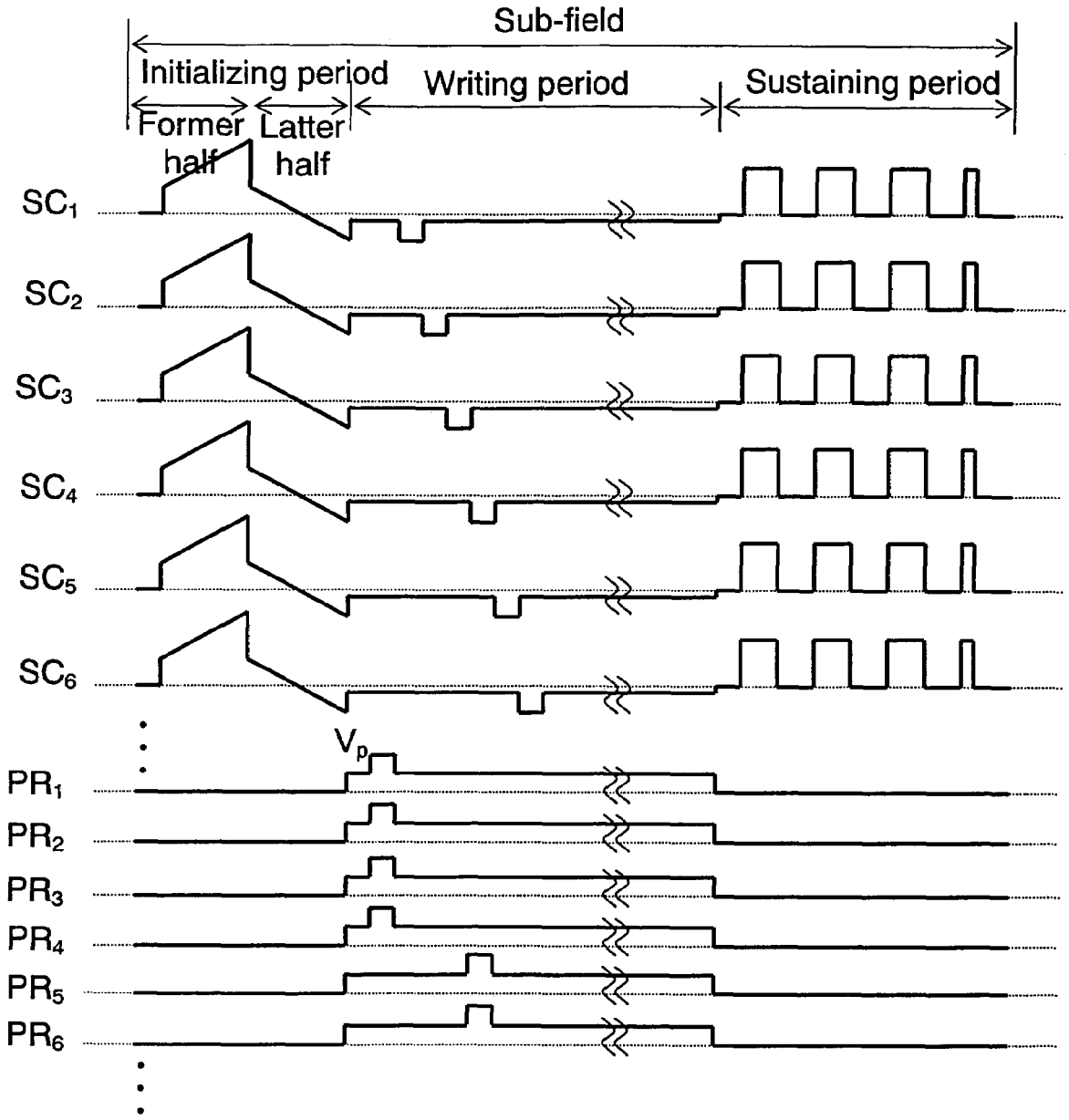
FIG. 6 is a diagram showing still another driving waveform in a method of driving the panel.
Figure 7:
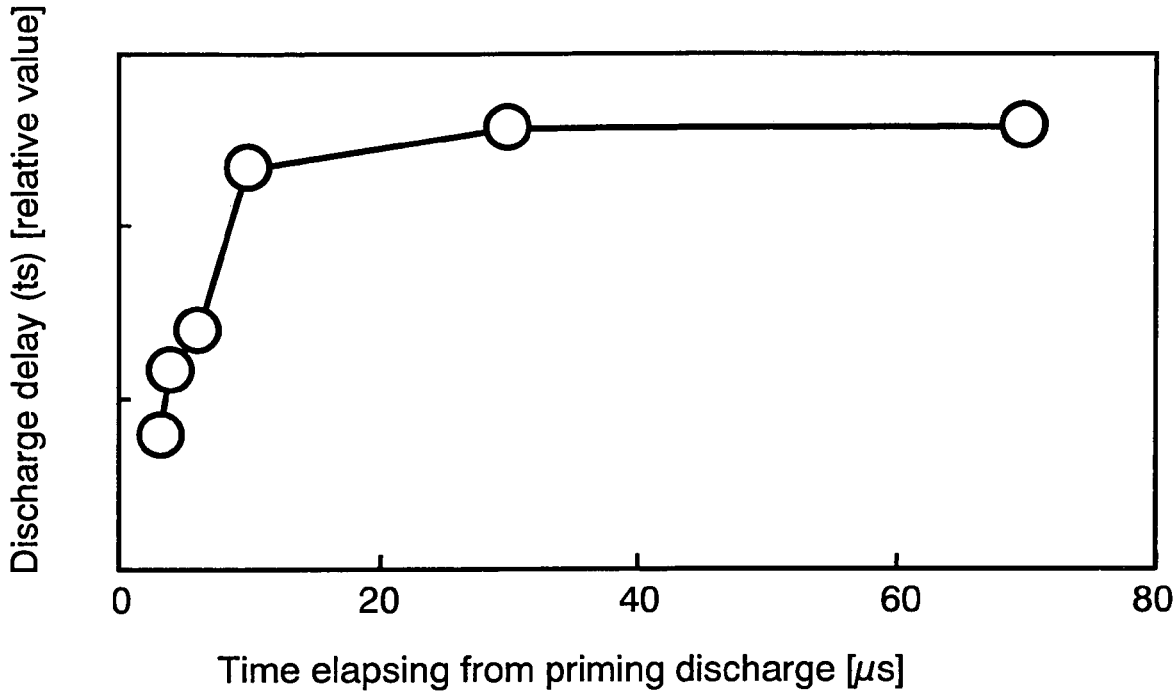
FIG. 7 is a graph showing a relation between time elapsing from priming discharge and discharge delay.

FIG. 6 is a diagram showing still another driving waveform in a method of driving a panel used for the first exemplary embodiment of the present invention. As shown in FIG. 6, to share a driver circuit and reduce the number of circuits, the timing of some priming pulses can be made the same. In FIG. 6, the timing of the priming pulses applied to priming electrodes $PR_2$, $PR_3$, and $PR_4$ are the same as the timing of the priming pulse applied to priming electrode $PR_1$. The timing of the priming pulses applied to priming electrodes $PR_6$, $PR_7$, and $PR_8$ are the same as the timing of the priming pulse applied to priming electrode $PR_5$. In this case, for discharge cells $C_{4,1}$ to $C_{4,m}$ in the forth row, for example, the priming discharge of priming electrode $PR_4$ is performed at the same timing as priming electrode $PR_1$. For this reason, although a curtain degree of time interval is provided from the priming discharge to the writing operation in discharge cells $C_{4,1}$ to $C_{4,m}$ in the fourth row, sufficient priming still remains after such a degree of time interval and thus writing can be performed with a small discharge delay. FIG. 7 is a graph showing the relation between the time elapsing from the priming discharge and the discharge delay. As shown in this graph, experiments show that writing operation can be performed with a small discharge delay when performed within 10 μs after the priming discharge.

Second Exemplary Embodiment

Figure 8:
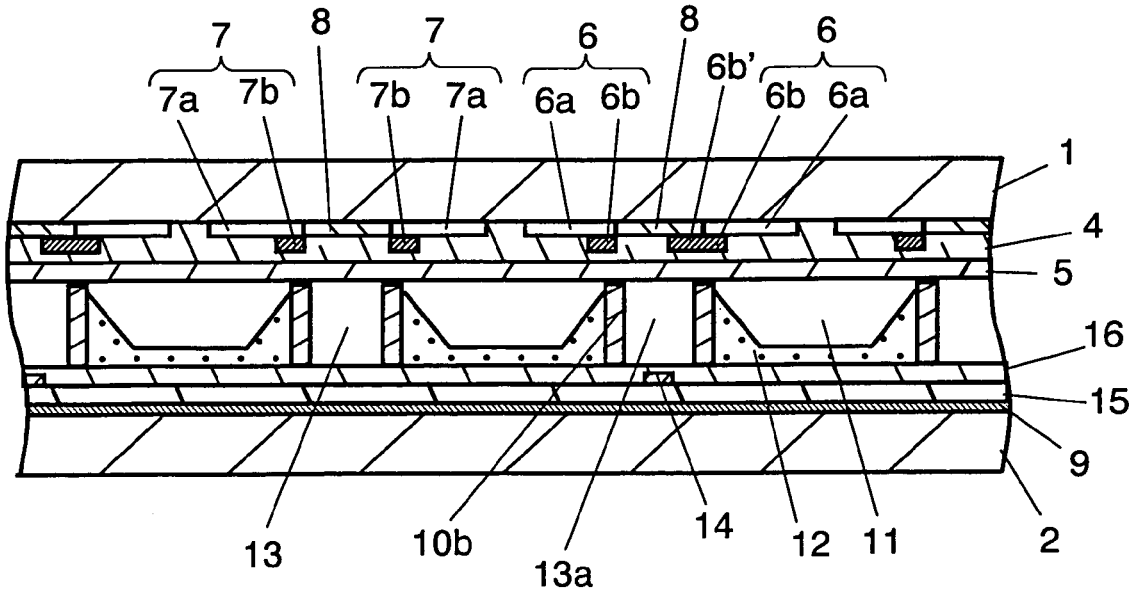
FIG. 8 is a sectional view showing an example of a panel used for a second exemplary embodiment of the present invention.
Figure 9:
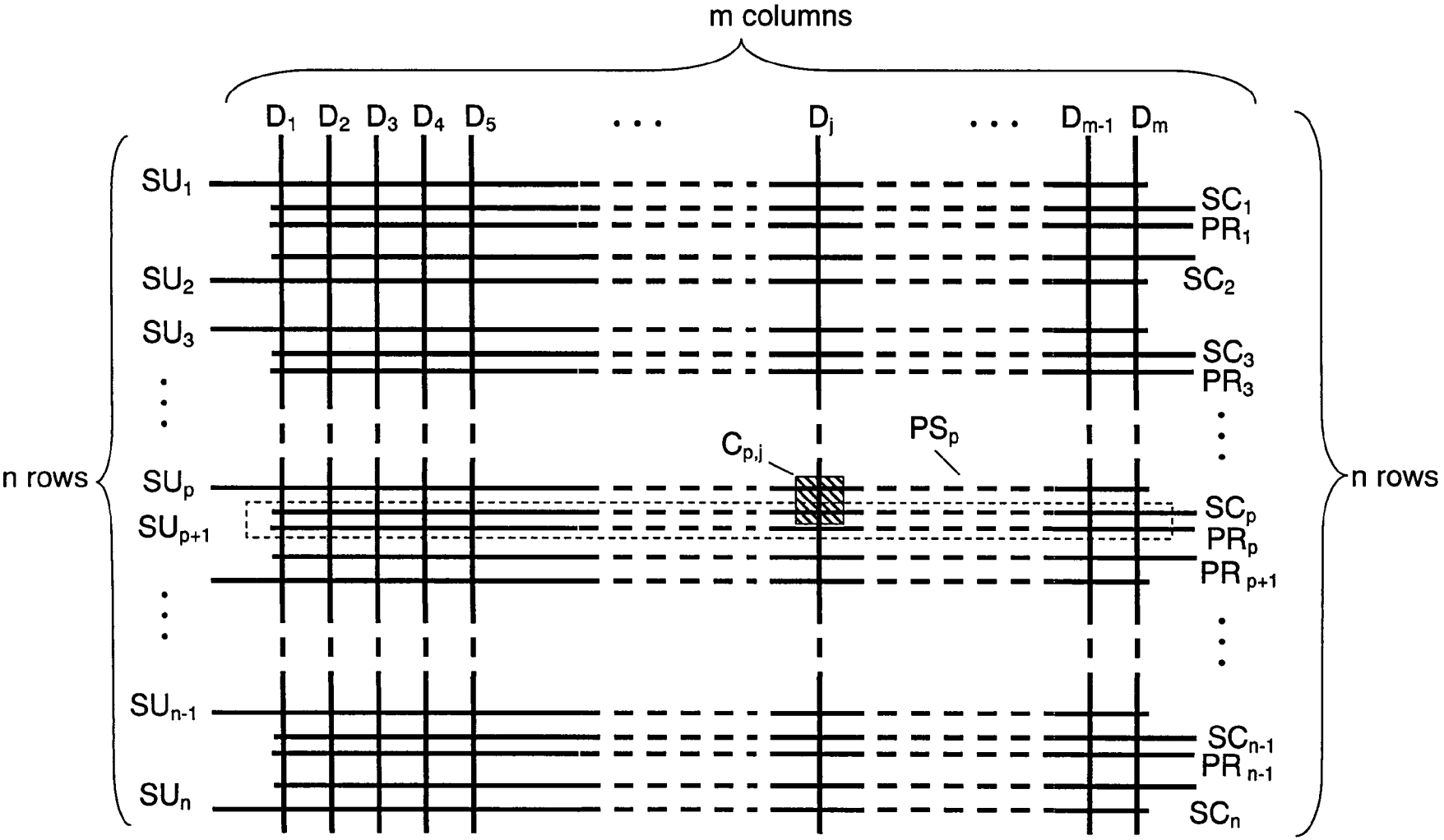
FIG. 9 is a diagram showing an arrangement of electrodes in the panel.

FIG. 8 is a sectional view showing an example of a panel used for the second exemplary embodiment of the present invention. FIG. 9 is a diagram showing an arrangement of electrodes in the panel. Same elements used in the first exemplary embodiment are denoted with the same reference marks and description thereof is omitted. In this embodiment, what is different from the first exemplary embodiment is that scan electrodes 6 and sustain electrodes 7 are alternately arranged in pairs like sustain electrode $SU_1$-scan electrode $SC_1$-scan electrode $SC_2$-sustain electrode $SU_2$, etc. Therefore, priming electrode 14 is formed only in clearance 13 corresponding to the portion where a pair of scan electrodes 6 is adjacent to each other, to form priming space 13*a*. Consequently, while n rows of priming electrodes 14 are provided in corresponding clearances 13 in the first exemplary embodiment, n/2 rows of priming electrodes 14 are provided in every other one of clearances 13. Then, projection 6*b*' of metal bus 6*b* in only one of a pair of scan electrodes 6 is extended to the position corresponding to clearance 13 and formed on light-absorbing layer 8. In other words, priming discharge occurs between projection 6*b*' of metal bus 6*b* in one of adjacent scan electrodes 6 and priming electrode 14 formed on the side of rear substrate 2. In this embodiment, projections 6*b*' are provided only on odd-numbered scan electrodes $SC_1$, $SC_3$, etc. As described above, the panel used for the second exemplary embodiment is structured so that the priming space 13*a* of one row supplies priming to discharge cells in two rows.

Next, a driving waveform for driving the above panel and the timing thereof are described.

Figure 10:
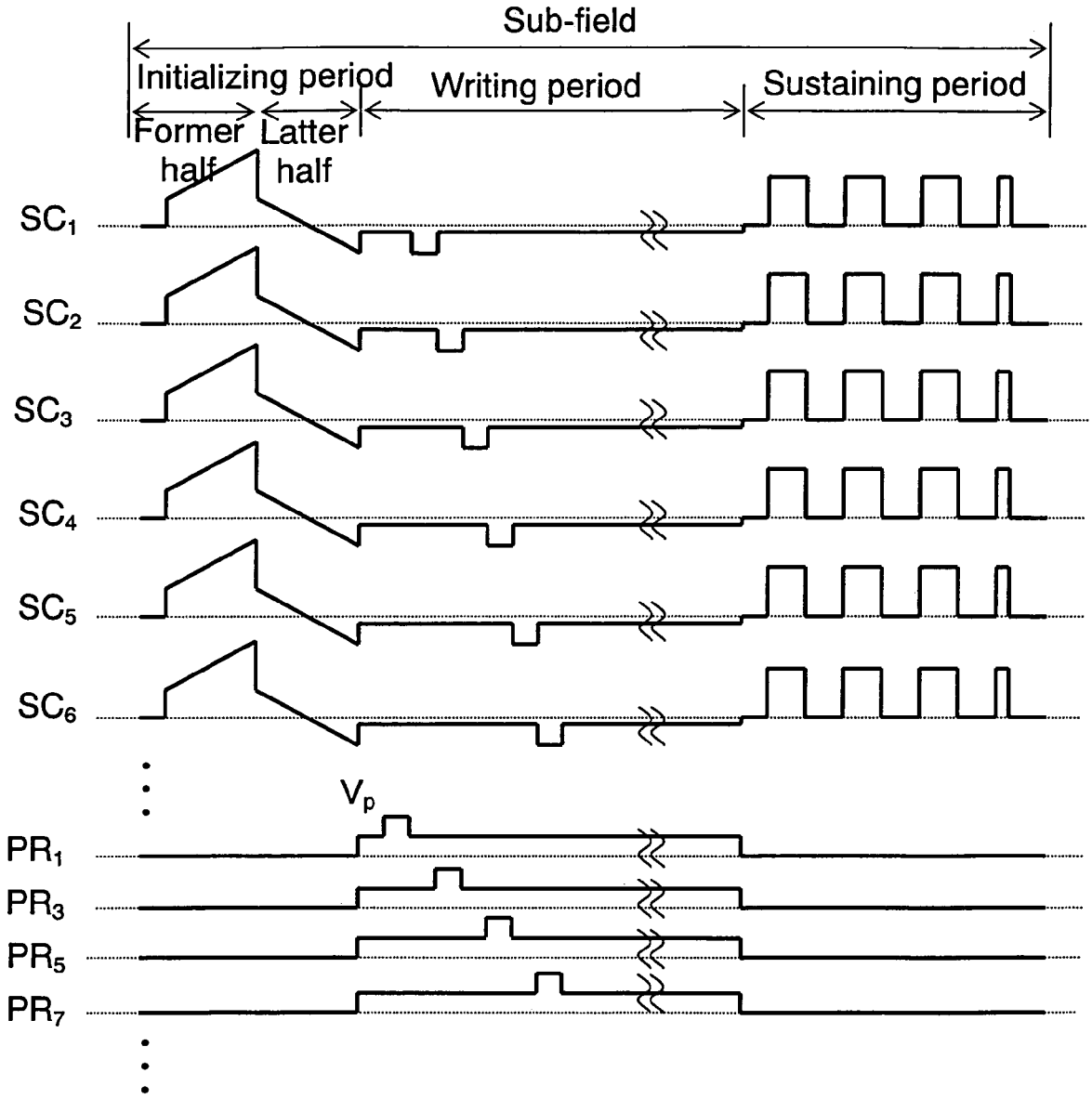
FIG. 10 is a diagram showing a driving waveform in a method of driving the panel.

FIG. 10 is a diagram showing a driving waveform in the method of driving the panel used for the second exemplary embodiment of the present invention. Also in this embodiment, operation in one sub-field is described.

Because the operation in the initializing period is the same as that of the first exemplary embodiment, description thereof is omitted.

In the writing period, like the first exemplary embodiment, scan electrodes $SC_1$ to $SC_n$ are held at voltage Vc once, and voltage Vp is applied to priming electrode $PR_1$ of the first row. Then, priming discharge occurs between priming electrode $PR_1$ and the projection of scan electrode $SC_1$. Thus, the priming diffuses inside of discharge cells $C_{1,1}$ to $C_{1,m}$ in the first row corresponding to scan electrode $SC_1$. The priming also diffuses inside of discharge cells $C_{2,1}$ to $C_{2,m}$ in the second row corresponding to scan electrode $SC_2$, at the same time.

Next, scan pulse voltage Va is applied to scan electrode $SC_1$ of the first row, and write pulse voltage Vd corresponding to video signals is applied to data electrode $D_k$ (k being an integer ranging from 1 to m), for writing operation on discharge cell $C_{1,k}$ in the first row.

Sequentially, scan pulse voltage Va is applied to scan electrode $SC_2$ of the second row, and write pulse voltage Vd corresponding to video signals is applied to data electrode $D_k$ (k being an integer ranging from 1 to m), for the writing operation in discharge cell $C_{2,k}$ in the second row. At this time, at the same time as the above writing operation using scan electrode $SC_2$ of the second row, voltage Vp is applied to priming electrode $PR_3$ corresponding to scan electrode $SC_3$ of the third row to cause priming discharge. Then, the priming diffuses inside of discharge cells $C_{3,1}$ to $C_{3,m}$ in the third row corresponding to scan electrode $SC_3$ of the third row and discharge cells $C_{4,1}$ to $C_{4,m}$ in the fourth row corresponding to scan electrode $SC_4$ of the fourth row.

In the same manner, writing operations are sequentially performed. However, in the writing operation in odd-numbered discharge cells $C_{p,1}$ to $C_{p,m}$ (p=1, 3, 5, etc.), no priming discharge is caused. In contrast, in the writing operation in even-numbered discharge cells $C_{q,1}$ to $C_{q,m}$ (q=2, 4, 6, etc), priming discharge is caused in priming electrode $PR_{q+1}$ corresponding to the (q+1)-th scan electrode $SC_{q+1}$, and the priming diffuses inside of discharge cells $C_{q+1,1}$ to $C_{q+1,m}$ in the (q+1)-th row and discharge cells $C_{q+2,1}$ to $C_{q+2,m}$ in the (q+2)-th row.

The similar writing operations are performed in the discharge cells including those in the n-th row, and the writing operations are completed.

The operation in the sustaining period is the same as that of the first exemplary embodiment, and thus the description thereof is omitted.

As described above, like the first exemplary embodiment, the writing discharge in the driving method of the present invention is performed with sufficient priming supplied from the priming discharge that has occurred immediately before the writing operation in respective discharge cells. For this reason, the discharge delay is small, and thus high-speed and stable discharge is possible.

Further, in the second exemplary embodiment, electrodes in the vicinity of priming spaces 13*a* are priming electrodes 14 and scan electrodes 6 only. This also gives an advantage of stable action of the priming discharge itself because the priming discharge is unlikely to cause other unnecessary discharge, e.g., incorrect discharge involving sustain electrodes 7.

Incidentally, as shown in FIG. 10, like the first exemplary embodiment, in the second exemplary embodiment, a voltage of Vq not larger than the discharge-starting voltage can commonly be applied to all the priming electrodes $PR_1$ to $PR_n$, and a voltage of Vp−Vq can be further applied to priming electrodes to be discharged, in the writing period.

Figure 11:
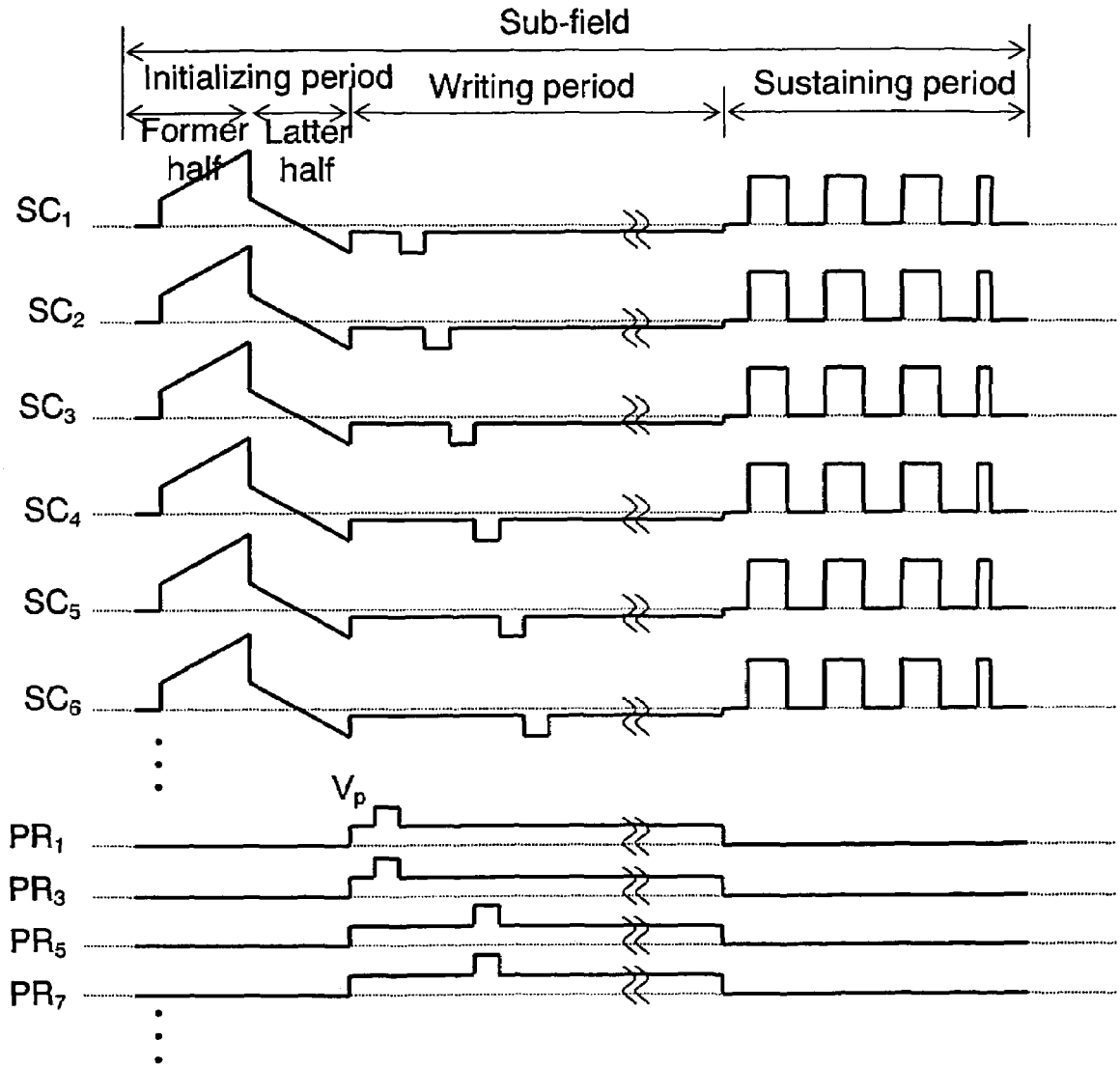
FIG. 11 is a diagram showing another driving waveform in a method of driving the panel.

FIG. 11 is a diagram showing another waveform in a method of driving the panel used for the second exemplary embodiment. As shown in the waveform, the timing of some priming pulses can be made the same. In FIG. 11, the timing of the priming pulse applied to priming electrode $PR_3$ is the same as the timing of the priming pulse applied to priming electrode $PR_1$. The timing of the priming pulse applied to priming electrode $PR_7$ is the same as the timing of the priming pulse applied to priming electrode $PR_5$. However, it is important to cause writing discharge within 10 μs after the priming discharge.

Incidentally, respective electrodes of an AC type PDP are surrounded by the dielectric layers and insulated from the discharge space. For this reason, direct-current components make no contribution to discharge itself. Therefore, of course, even the use of waveforms in which direct-current components are added to the driving waveforms of the first or second exemplary embodiment can provide similar effects.

Figure 12:
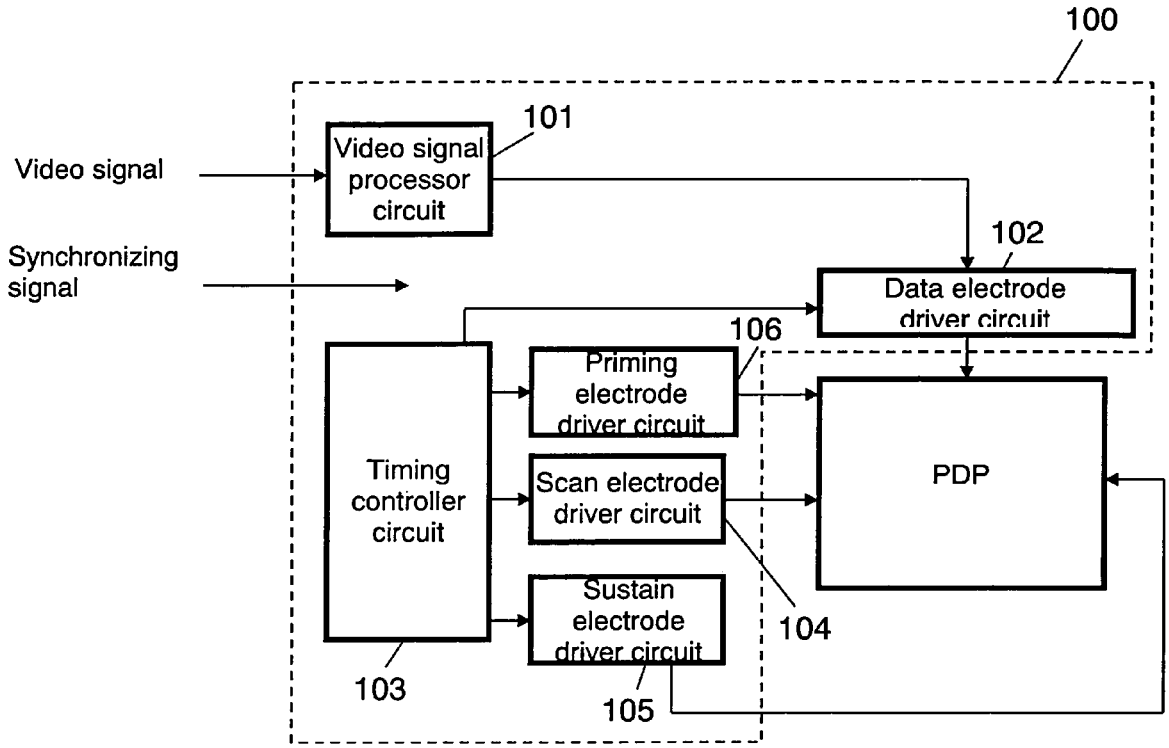
FIG. 12 is diagram showing an example of a circuit block of a driver for implementing the methods of driving the panels used for the first and second exemplary embodiments.

FIG. 12 is a diagram showing an example of a circuit block of a driver for implementing the methods of driving the panels used for the first and second exemplary embodiments. Driver 100 of the exemplary embodiments of the present invention includes: video signal processor circuit 101, data electrode driver circuit 102, timing controller circuit 103, scan electrode driver circuit 104 and sustain electrode driver circuit 105, and priming electrode driver circuit 106. A video signal and synchronizing signal are fed into video signal processor circuit 101. Responsive to the video signal and synchronizing signal, video signal processor circuit 101 outputs a sub-field signal for controlling whether or not to light each sub-field, to data electrode driver circuit 102. The synchronizing signal is also fed into timing controller circuit 103. Responsive to the synchronizing signal, timing controller circuit 103 outputs a timing control signal to data electrode driver circuit 102, scan electrode driver circuit 104, sustain electrode driver circuit 105, and priming electrode driver circuit 106.

Responsive to the sub-field signal and the timing control signal, data electrode driver circuit 102 applies a predetermined driving waveform to data electrodes 9 (data electrodes $D_1$ to $D_m$ in FIG. 3) in the panel. Responsive to the timing control signal, scan electrode driver circuit 104 applies a predetermined driving waveform to scan electrodes 6 (scan electrodes $SC_1$ to $SC_n$ in FIG. 3) in the panel. Responsive to the timing control signal, sustain electrode driver circuit 105 applies a predetermined driving waveform to sustain electrodes 7 (sustain electrodes $SU_1$ to $SU_n$ in FIG. 3) in the panel. Responsive to the timing control signal, priming electrode driver circuit 106 applies a predetermined driving waveform to priming electrodes 14 (priming electrodes $PR_1$ to $PR_n$ in FIG. 3) in the panel. Necessary electric power is supplied to data electrode driver circuit 102, scan electrode driver circuit 104, sustain electrode driver circuit 105, and priming electrode driver circuit 106 from a power supply circuit.

The above circuit block can constitute a driver for implementing the methods of driving the panels of the exemplary embodiments of the present invention.

As described above, the present invention can provide a method of driving a plasma display panel capable of performing stable and high-speed writing operation.

INDUSTRIAL APPLICABILITY

The method of driving a plasma display panel of the present invention can perform stable and high-speed writing operation. Thus, the present invention is useful as a method of driving an AC type plasma display panel.

The invention claimed is:

1. A method for driving a plasma display panel including a plurality of scan electrodes and a plurality of sustain electrodes disposed parallel to each other on a front substrate, a plurality of data electrodes disposed in a direction intersecting a direction of the scan electrodes on a rear substrate, and a plurality of priming electrodes disposed in a direction parallel to the direction of the scan electrodes on the rear substrate, each of the plurality of scan electrodes being aligned to protrude toward a corresponding one of the plurality of priming electrodes to form a priming space therebetween, the priming electrodes for generating a priming discharge between the priming electrodes and the corresponding scan electrodes, whereby one field period is made of a plurality of sub-fields, each of the sub-fields including an initializing period, a writing period and a sustaining period, the method comprising:

prior to applying a scanning voltage to the scan electrodes corresponding to the respective priming electrodes, applying, to the respective priming electrodes, a voltage synchronized to a cycle of the sub-field for causing a priming discharge between the priming electrodes and the corresponding scan electrodes, in the writing period of each of the sub-fields.

2. A method according to claim 1, wherein the plasma display panel further includes:

a plurality of vertical wall portions extending parallel to the data electrodes; and a plurality of horizontal wall portions extending perpendicular to the vertical wall portions, wherein the vertical wall portions and the horizontal wall portions form a plurality of discharge cells and the horizontal wall portions form a plurality of spaces between the discharge cells, and the priming electrodes are disposed at the spaces and intersect the data electrodes.

3. A method according to claim 2, wherein the scan electrodes and the sustain electrodes are disposed alternatively one by one on the front substrate, and the plasma display panel further includes a light absorbing layer disposed between the scan electrodes and the sustain electrodes at positions facing the spaces.

4. A method according to claim 2, wherein the scan electrodes and the sustain electrodes are disposed alternatively two by two on the front substrate, and the plasma display panel further includes a light absorbing layer disposed between adjacent scan electrodes at positions facing the spaces.

5. A method according to claim 3, wherein each of the scan electrodes and the sustain electrodes includes:

a transparent electrode; and a metal bus line disposed on the transparent electrode, and each of the metal bus lines of the scan electrodes has a protruding portion projecting to the light absorbing layer.

6. A method according to claim 4, wherein each of the scan electrodes and the sustain electrodes includes:

a transparent electrode; and a metal bus line disposed on the transparent electrode, and each of the metal bus lines of the scan electrodes has a protruding portion projecting to the light absorbing layer.

7. A method according to claim 1, wherein a time interval between the applying of the voltage synchronized to the sub-field cycle to the respective priming electrodes for causing the priming discharge and the applying of the scanning voltage to the corresponding scan electrodes is within 10 μs, in the writing period of the sub-fields.

8. A method according to claim 7, further comprising:

applying a voltage that is less than a discharge start voltage to all of the priming electrodes, wherein the applying of the voltage synchronized to the sub-field cycle to the respective priming electrodes for causing the priming discharge occurs in the writing period during the applying of the voltage that is less than the discharge start voltage to all of the priming electrodes.

9. A method according the claim 7, wherein the applying of the voltage synchronized to the sub-field cycle for causing the priming discharge occurs with a same timing for two or more of the respective priming electrodes.

10. A method according to claim 2, wherein a time interval between the applying of the voltage synchronized to the sub-field cycle to the respective priming electrodes for causing the priming discharge and the applying of the scanning voltage to the corresponding scan electrodes is within 10 μs, in the writing period of the sub-fields.

11. A method according to claim 3, wherein a time interval between the applying of the voltage synchronized to the sub-field cycle to the respective priming electrodes for causing the priming discharge and the applying of the scanning voltage to the corresponding scan electrodes is within 10 μs, in the writing period of the sub-fields.

12. A method according to claim 4, wherein a time interval between the applying of the voltage synchronized to the sub-field cycle to the respective priming electrodes for causing the priming discharge and the applying of the scanning voltage to the corresponding scan electrodes is within 10 μs, in the writing period of the sub-fields.

13. A method according to claim 5, wherein a time interval between the applying of the voltage synchronized to the sub-field cycle to the respective priming electrodes for causing the priming discharge and the applying of the scanning voltage to the corresponding scan electrodes is within 10 μs, in the writing period of the sub-fields.

14. A method according to claim 6, wherein a time interval between the applying of the voltage synchronized to the sub-field cycle to the respective priming electrodes for causing the priming discharge and the applying of the scanning voltage to the corresponding scan electrodes is within 10 μs, in the writing period of the sub-fields.

15. A method according the claim 10, wherein the applying of the voltage synchronized to the sub-field cycle for causing the priming discharge occurs with a same timing for two or more of the respective priming electrodes.

16. A method according the claim 11, wherein the applying of the voltage synchronized to the sub-field cycle for causing the priming discharge occurs with a same timing for two or more of the respective priming electrodes.

17. A method according the claim 12, wherein the applying of the voltage synchronized to the sub-field cycle for causing the priming discharge occurs with a same timing for two or more of the respective priming electrodes.

18. A method according the claim 13, wherein the applying of the voltage synchronized to the sub-field cycle for causing the priming discharge occurs with a same timing for two or more of the respective priming electrodes.

19. A method according the claim 14, wherein the applying of the voltage synchronized to the sub-field cycle for causing the priming discharge occurs with a same timing for two or more of the respective priming electrodes.

* * * * *